US006056299A

United States Patent [19]

Soo

[11] Patent Number: 6,056,299

[45] Date of Patent: May 2, 2000

[54] SKATE BASE STRUCTURE

[76] Inventor: Mike Soo, No. 931, Chung Shan Road, Jen Teh Shiang, Tainan Hsien, Taiwan

[21] Appl. No.: 09/241,146

[22] Filed: Feb. 1, 1999

[51] Int. Cl.[7] ..... A63C 17/06

[52] U.S. Cl. ..... 280/11.22; 280/11.15; 280/11.27

[58] Field of Search ..... 280/11.22, 11.23, 280/600, 842, 11.15, 11.17, 11.18, 614, 615, 618, 11.27, 11.28; 16/374; 403/113, 163

[56] References Cited

U.S. PATENT DOCUMENTS

| | | | |
|---|---|---|---|
| 249,305 | 11/1881 | Clark | 16/374 X |
| 835,116 | 11/1906 | Schmidt | 16/374 X |
| 1,394,863 | 10/1921 | Reynolds | 403/113 X |
| 2,121,572 | 6/1938 | Polden et al. | 403/113 X |
| 2,516,238 | 7/1950 | Mortsell | 280/615 |
| 3,344,538 | 10/1967 | Massicotte | 280/615 X |
| 5,190,309 | 3/1993 | Spitaler et al. | 280/615 |
| 5,890,724 | 4/1999 | Gignoux et al. | 280/11.22 X |

FOREIGN PATENT DOCUMENTS

| | | | |
|---|---|---|---|
| 0 192 312 | 8/1986 | European Pat. Off. . | |
| 2527611 | 12/1976 | Germany | 280/842 |
| 96/37269 | 11/1996 | WIPO . | |

*Primary Examiner*—Michael Mar
*Attorney, Agent, or Firm*—Alan Kamrath Oppenheimer Wolff & Donnelly LLP

[57] ABSTRACT

A base structure for a skate includes a base including an upper side having a front end and a rear end, a pivotal seat mounted to the front end of the base, and a connecting rod mounted above the base. The pivotal seat includes two lateral walls and a recess defined in an upper side thereof The connecting rod includes a front end pivotally connected between the lateral walls of the pivotal seat. The connecting rod is attached to an underside of a shoe. The front end of the connecting rod includes a hooked section formed on an underside thereof for bearing against a rear side wall that defines a portion of the recess of the pivotal seat, thereby restraining pivotal movement of the connecting rod relative to the pivotal seat.

3 Claims, 8 Drawing Sheets

SKATE BASE STRUCTURE

BACKGROUND OF THE INVENTION

1. Field of the Invention

The present invention relates to a skate base structure for beginners and speed skating racers.

2. Description of the Related Art

Skating is not easy as many factors such as balance, skill, speed, etc are involved. A beginner often has to experience many times of fall before he/she can control the skates well. FIG. 7 of the drawings illustrates a typical ice skate 70 that includes a base 72, a blade 74 attached to an underside of the base 72, and a supporting frame 73 mounted on an upper side of the base 72 for attaching a shoe 71. FIG. 8 of the drawings illustrates a typical roller skate 80 that includes a base 82, a number of in-line rollers 83 attached to an underside of the base 82, and a shoe 81 attached to an upper side of the base 82. Control of either skate 70, 80 is not difficult for a skilled skater. Yet, a beginner often has fear when lifting his/her legs upwardly as the contact area between the skate and the ground becomes relatively small. This is why the beginner falls easily, and the fall results in fear and/or injury to the beginner. The beginner may even quit skating. A problem is also found when wearing such typical skates to attend speed skating. It is a burden to the racer to repeatedly lift the legs and the whole skates in the start and during the rush stage. In addition, the front end of the blade 74 or the most front wheel 83 tends to wear quickly as it is subjected to large forces frequently. The present invention is intended to provide an improved skate base structure that mitigates and/or obviates the above problems.

SUMMARY OF THE INVENTION

It is a primary object of the present invention to provide an improved skate base structure for beginners and for speed skating racers.

The skate base structure in accordance with the present invention allows the skater to lift only the rear part of the shoe, while the rollers of a roller skate or the blade of an ice skate remain on the ground to thereby provide a larger contact area between the skate and the ground. A beginner may feel more balanced when lifting his/her legs. For a skilled skater, he/she only has to lift the shoe on above the base when speed skating, i.e., only slight movements of the legs are required to increase the speed during the inertial sliding. The skater may be more agile.

In accordance with the present invention, a base structure for a skate comprises a base including an upper side having a front end and a rear end, a pivotal seat mounted to the front end of the base, and a connecting rod mounted above the base. The pivotal seat includes two lateral walls and a recess defined in an upper side thereof. The connecting rod includes a front end pivotally connected between the lateral walls of the pivotal seat. The connecting rod is attached to an underside of a shoe. The front end of the connecting rod includes a hooked section formed on an underside thereof for bearing against a rear side wall that defines a portion of the recess of the pivotal seat, thereby restraining pivotal movement of the connecting rod relative to the pivotal seat.

The front end of the connecting rod includes a transverse hole, and a bearing means is mounted in the transverse hole. The hooked section of the connecting rod includes a beveled operative surface, and wherein the rear side wall is inclined.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
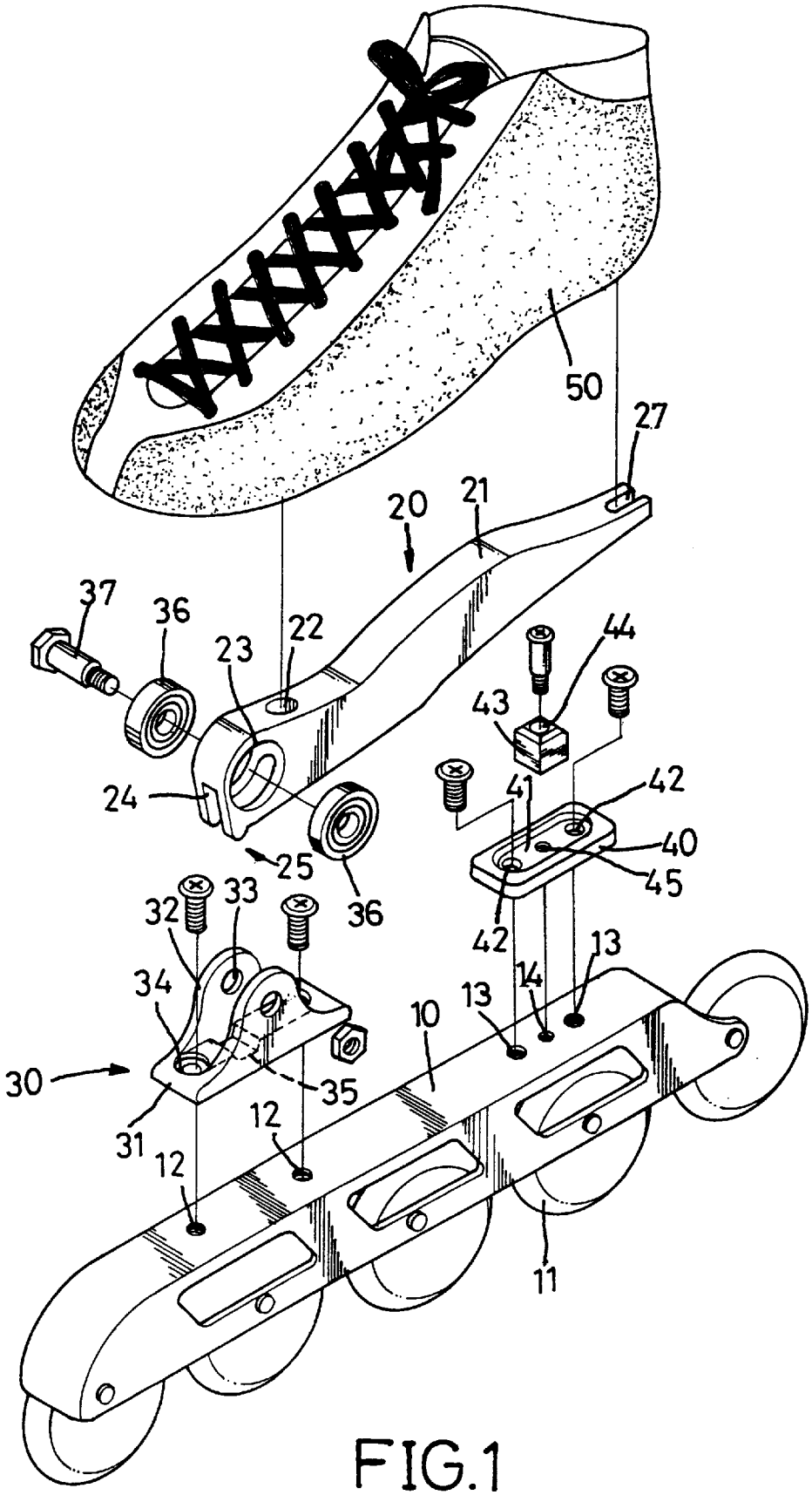
FIG. 1 is an exploded perspective view of an in-line roller skate with a base structure in accordance with the present invention.

FIG. 1 illustrates an in-line roller skate with a base structure in accordance with the present invention. The roller skate includes a base 10 having a number of rollers rotatably attached to an underside thereof A pivotal seat 30 is mounted to a front end of an upper side of the base 10 by means of extending screws (not labeled) through screw holes 34 in the pivotal seat 30 and screw holes 12 in the front end of the base 10. The pivotal base 30 includes two lateral walls 32 having aligned holes 33. The pivotal seat 30 further includes a recess 35 defined in an upper side thereof, which will be described later.

An abutting plate 40 is attached to a rear end of the upper side of the base 10 by means of extending screws (not labeled) through holes 42 in the abutting plate 40 and screw holes 13 in the rear end of the base 10. An abutting block 43, preferably made of plastic material (e.g., polyurethane), is secured in a groove 41 of the abutting plate 40 by means of extending a bolt (not labeled) through a hole 44 in the abutting block 43 and a screw hole 45 in the abutting plate 40. The abutting block 43 has a width such that the abutting block 43 is fittingly received in the groove 41.

Figure 2:
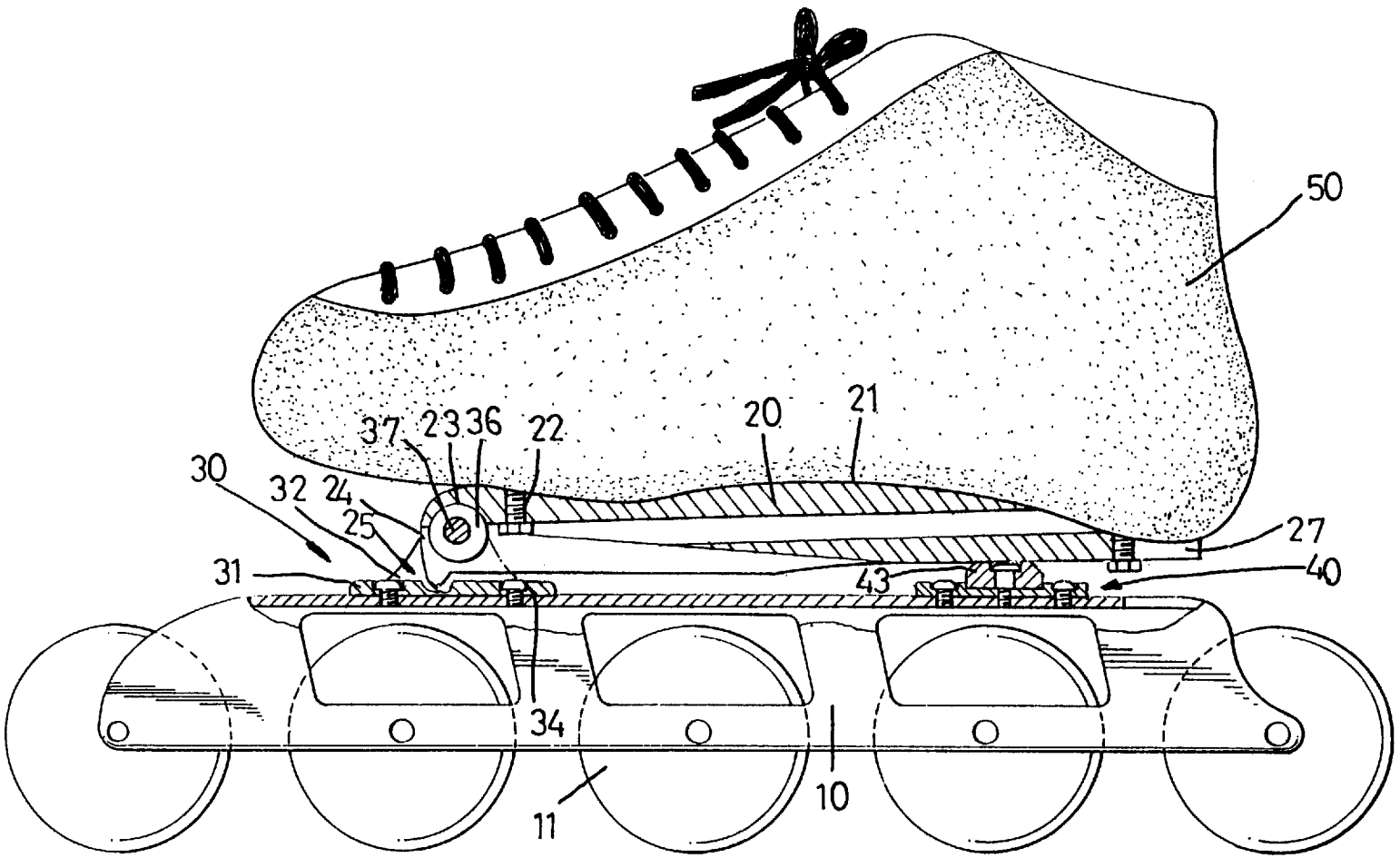
FIG. 2 is a side view, partially sectioned, of the roller skate.

A connecting rod 20 includes a front end pivotally connected to the pivotal seat 30. The front end of the connecting rod 20 includes a transverse hole 23 for receiving two bearings 36. The front end of the connecting rod 20 further includes an end face (not labeled) that has a cut 24 communicated with the transverse hole 23. A pivotal axle 37 is extended through the bearings 36 and the holes 33 in the pivotal base 30 to allow pivotal movement of the connecting rod 20 about the pivotal seat 30. The connecting rod 20 further includes an arcuate section 21 in an upper side thereof and a hooked section 25 formed on an underside thereof. In addition, the connecting rod 20 includes a hole 22 adjacent to the front end thereof and a slit 27 in a rear end thereof Screw or bolts (FIG. 2, not labeled) are extended through the hole 22 and the slit 27 to secure the connecting rod 20 to an underside of a shoe 50.

Figure 3:
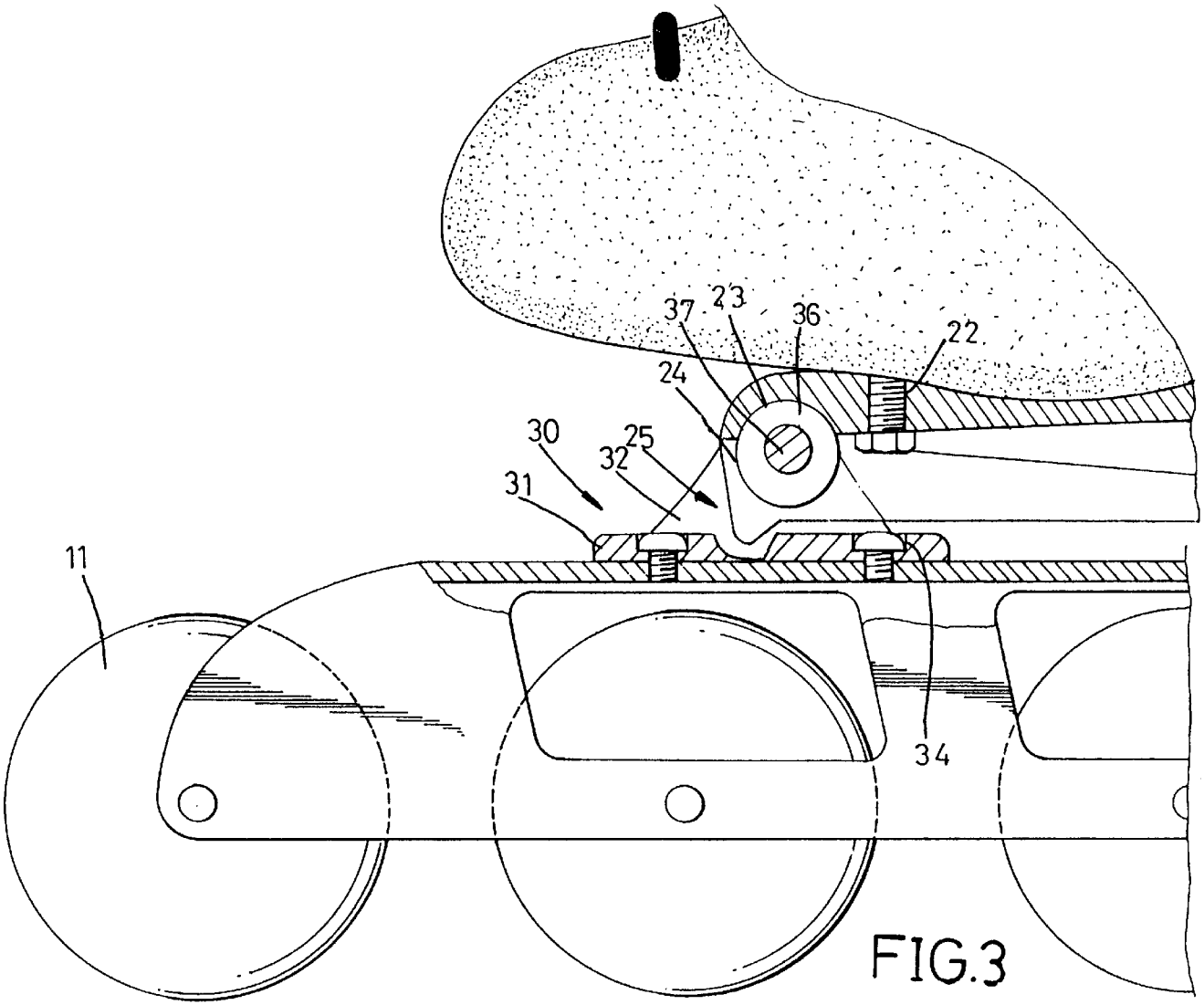
FIG. 3 is an enlarged side view illustrating a front portion of the roller skate in FIG. 2.
Figure 4:
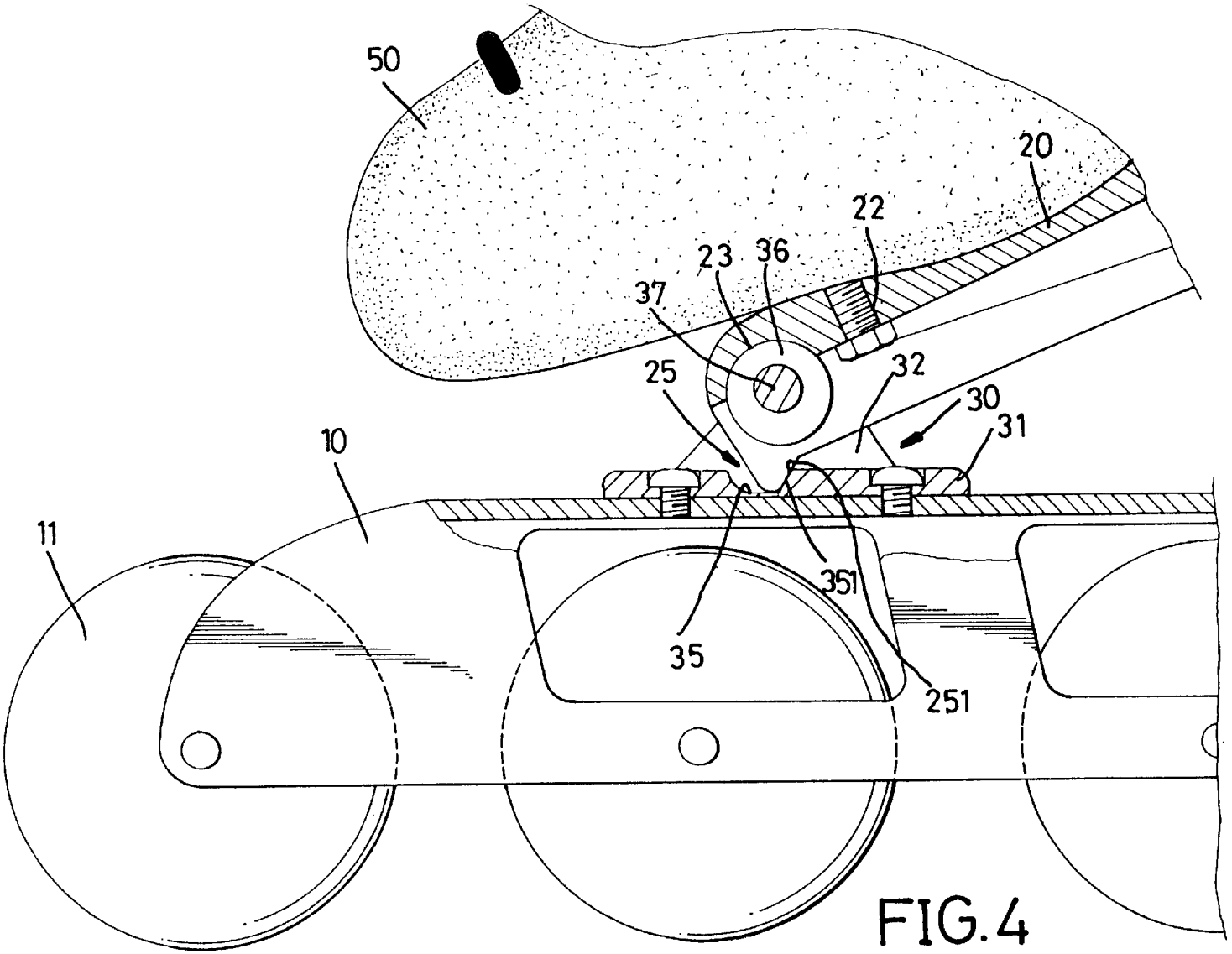
FIG. 4 is a view similar to FIG. 3, illustrating pivotal movement of a shoe on the base structure.
Figure 6:
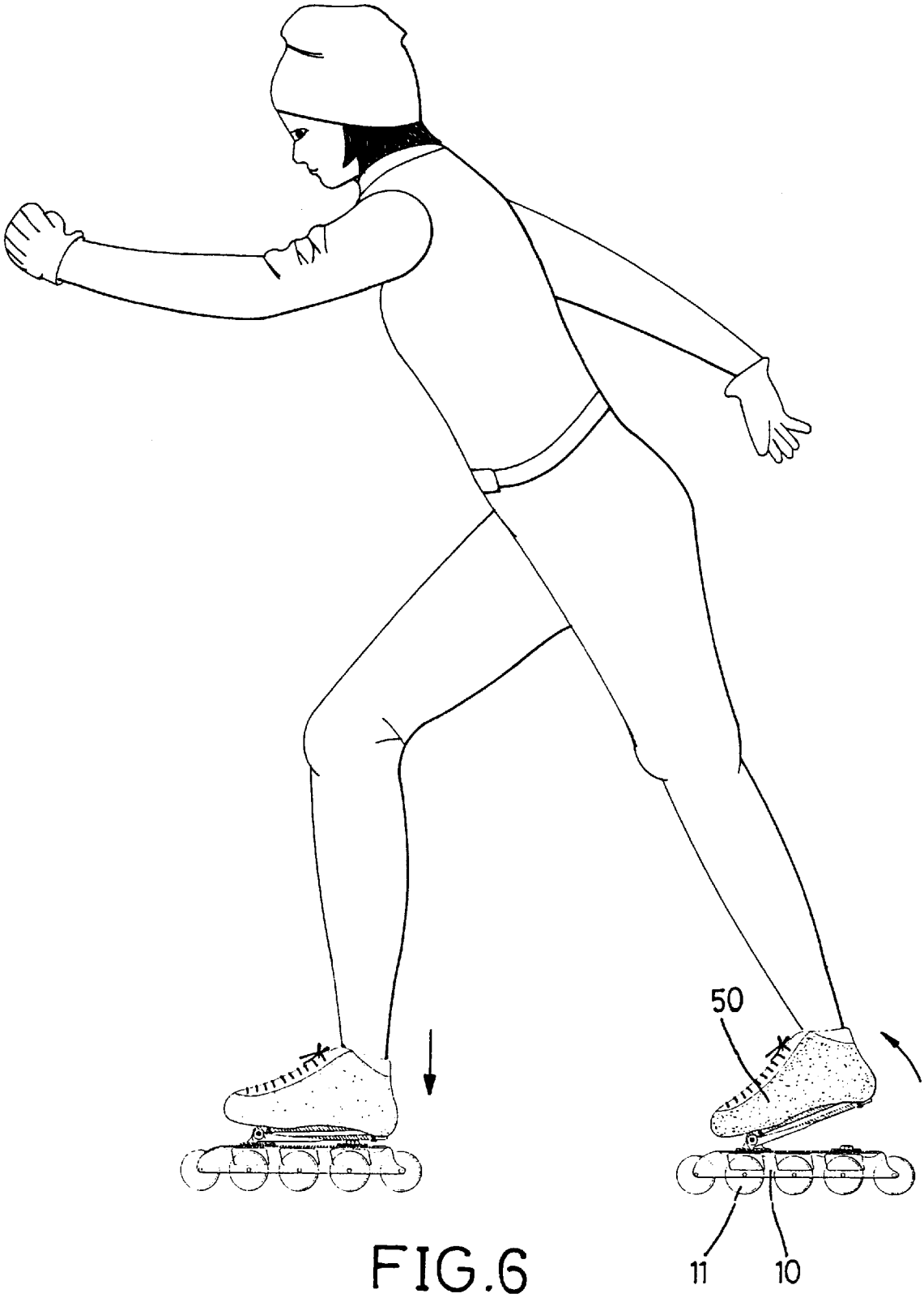
FIG. 6 is a schematic side view illustrating use of the in-line roller skates.
Figure 7:
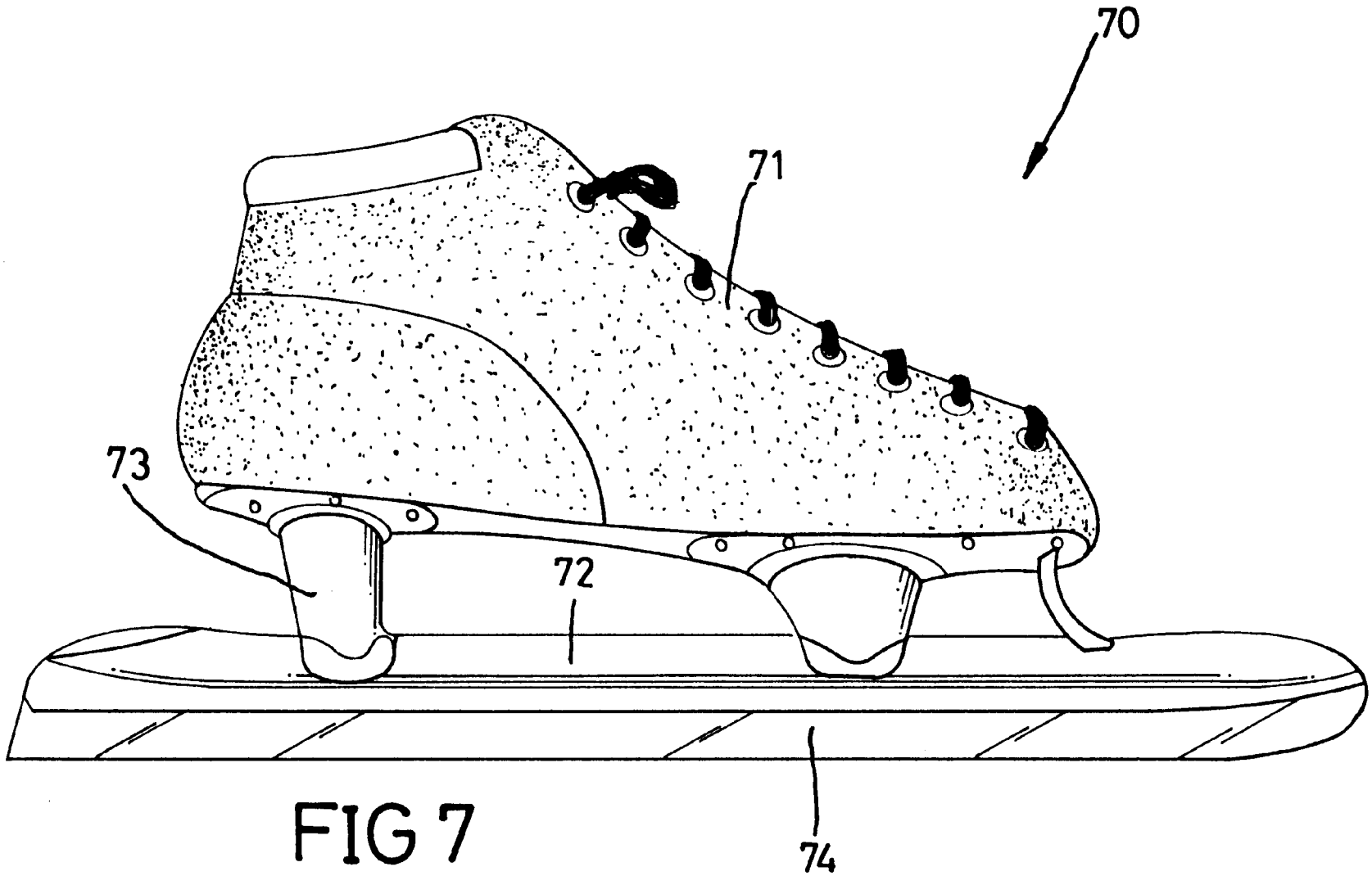
FIG 7 PRIOR ART
FIG. 7 is a perspective view of a conventional ice skate.
Figure 8:
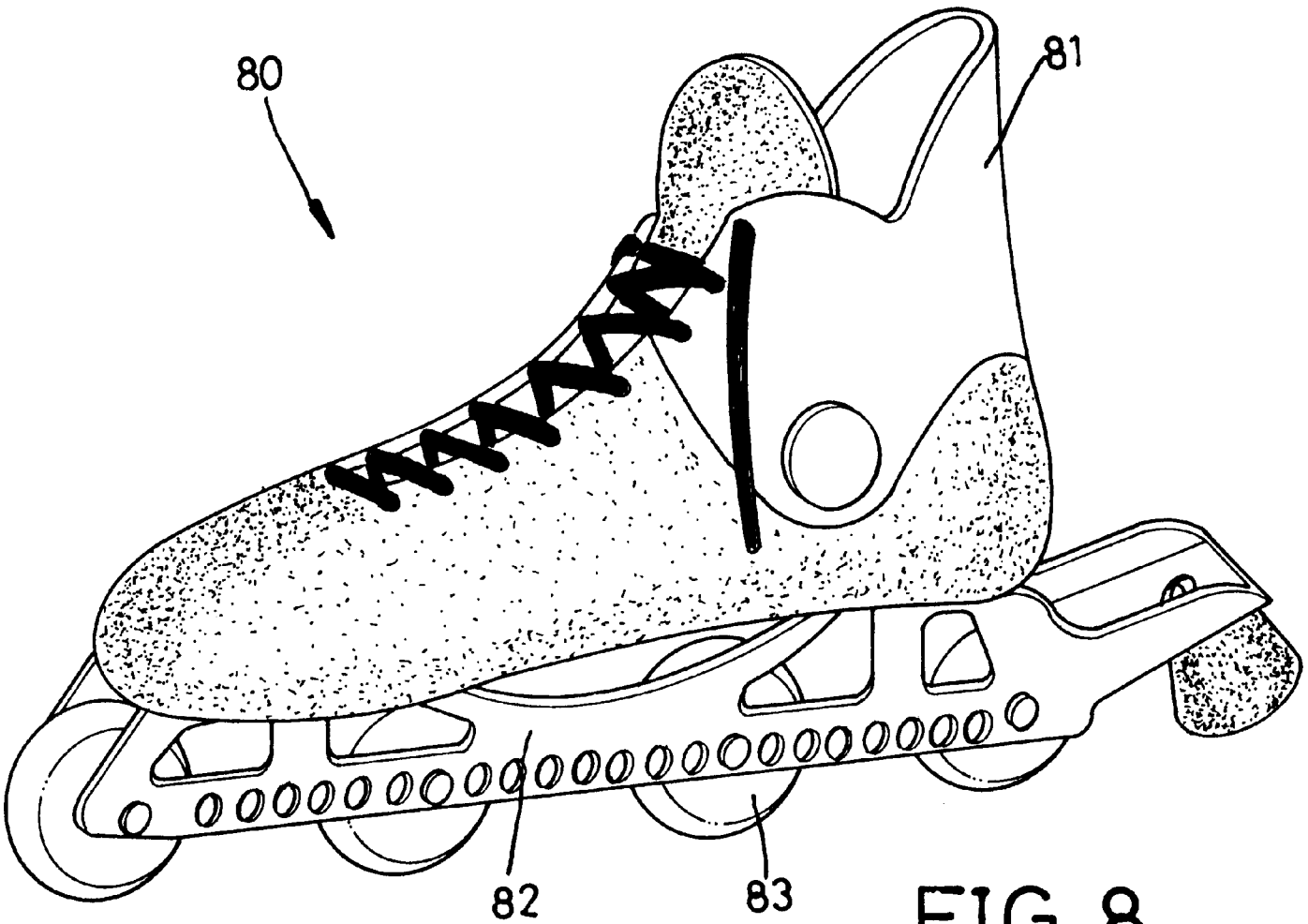
FIG. 8 PRIOR ART
FIG. 8 is a perspective view of a conventional roller skate.

When the skater slightly lifts the heel portion of his/her foot in the shoe 50, the connecting rod 20 and the shoe 50 are pivoted from a status shown in FIG. 3 to a status shown in FIG. 4. An operative beveled face 251 of the hooked section 25 on the underside of the connecting rod 20 bears against an inclined rear side wall 351 that defines a portion of the recess 35. This avoids excessive pivotal movement of the connecting rod 20 relative to the pivotal seat 30 to thereby avoid excessive inclination of the skater. Thus, as shown in FIG. 6, the rollers 11 of the roller skate remain on the ground. This gives a beginner a more balanced feeling. A speed skating racer is also benefited by the skates in accordance with the present invention, because small movements are required to increase the speed during the sliding movements of the skates and because the racer may swiftly move his/her feet alternately to increase the speed during the inertial sliding by minor movements. The base 10 is exerted by a force that may impart into an active rearward force to keep the skate moving forwardly. A further advantage of the roller skates in accordance with the present invention is that the skater is more agile. In addition, the rollers 11 are more durable.

Figure 5:
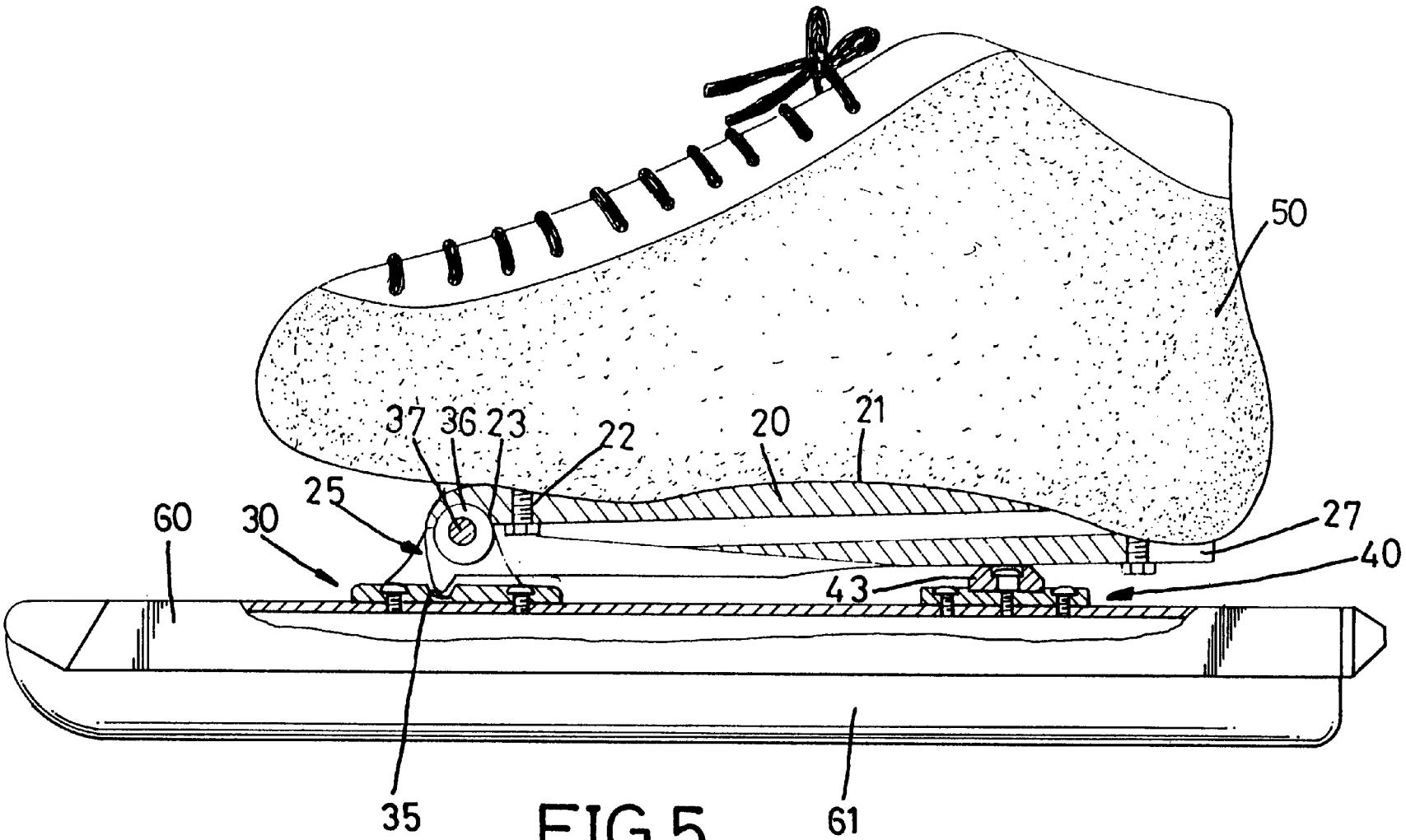
FIG. 5 is a partially sectioned side view of an ice skate with a base structure in accordance with the present invention.

FIG. 5 illustrates an ice skate with a base structure 60 in accordance with the present invention. The ice skate has all of the above advantages. The blade 61 is also more durable.

Although the invention has been explained in relation to its preferred embodiment, it is to be understood that many other possible modifications and variations can be made without departing from the spirit and scope of the invention as hereinafter claimed.

What is claimed is:

1. A base structure for a skate, comprising:

a base frame including a planar upper side having a front end and a rear end;

a pivotal seat mounted to the front end of the base frame the pivotal seat including a base portion having a bottom surface attached to the planar upper side of the base frame, two lateral walls extending upwardly from lateral sides of the base portion, and a recess defined in an upper side of the base portion and formed with front and rear side walls;

a connecting rod mounted above the base frame and including a front end pivotally connected between the lateral walls of the pivotal seat for pivotal movement between a raised position and a lowered position with the connecting rod extending parallel with the upper side of the base frame, the connecting rod being adapted to be attached to an underside of a shoe, the front end of the connecting rod including a hooked section formed on an underside thereof and extending downwardly into the recess, the hooked section being spaced from the front and rear side walls of the recess when the connecting rod is in the lowered position, the hooked section having a rear wall portion configured for bearing against the rear side wall that defines a portion of the recess of the pivotal seat, when the connecting rod is in the raised position, for restraining pivotal movement of the connecting rod relative to the pivotal seat.

2. The base structure as claimed in claim 1, wherein the front end of the connecting rod includes a transverse hole, and a bearing means is mounted in the transverse hole.

3. The base structure as claimed in claim 1, wherein the hooked section of the connecting rod includes a beveled operative surface, and wherein the rear side wall is inclined.

* * * * *